United States Patent [19]

Goodyear

[11] Patent Number: 4,700,829

[45] Date of Patent: Oct. 20, 1987

[54] OFFICE ORGANIZER FOR DESKS

[76] Inventor: Nelson Goodyear, Space 23 Regency Villa, 15111 Bushard, Westminster, Calif. 92683

[21] Appl. No.: 34,909

[22] Filed: Apr. 6, 1987

[51] Int. Cl.[4] ..... B43M 17/00

[52] U.S. Cl. ..... 206/214; 206/371; 217/7; D19/90; D19/91; 211/11; 211/163

[58] Field of Search ..... 206/214, 1.7, 224, 371; 211/11, 163; D19/90, 91; 217/7

[56] References Cited

U.S. PATENT DOCUMENTS

| | | | |
|---|---|---|---|
| 193,340 | 7/1877 | Lothrop | 206/214 X |
| D. 270,256 | 8/1983 | Sankey | D19/90 |
| 531,799 | 1/1895 | Hunt | 206/214 |
| 555,502 | 3/1896 | Ford | 206/214 |
| 888,005 | 5/1908 | Fraas | 206/214 X |
| 2,194,003 | 3/1940 | Brooks | 206/214 X |
| 3,327,688 | 6/1967 | Smith | 206/214 |

FOREIGN PATENT DOCUMENTS

| | | | |
|---|---|---|---|
| 521002 | 3/1931 | Fed. Rep. of Germany | 206/214 |
| 2381634 | 10/1978 | France | 206/214 |

OTHER PUBLICATIONS

Desk Top Efficiency Center, 8/8/84, Washington Post.

*Primary Examiner*—William Price

*Attorney, Agent, or Firm*—Shlesinger, Arkwright, Garvey

[57] ABSTRACT

An office organizer for desks having multiple compartments or containers, trays, slots and cups for retaining or storing tools and materials used in office work and for easy access thereof.

14 Claims, 4 Drawing Figures

OFFICE ORGANIZER FOR DESKS

BACKGROUND OF THE INVENTION

This invention relates to an office organizer for desks and, more particularly, to an office organizer incorporating features of convenience, compactness, speed of access and availability of tools and materials used in office work to a degree never accomplished before.

Office organizers are well known in the art. Examples of these for which patents have been issued are: U.S. Pat. No. 193,340 issued to Lothrop; U.S. Pat. No. 3,327,688 issued to Smith; U.S. Pat. No. 555,502 issued to Ford; U.S. Pat. No. 531,799 issued to Hunt; U.S. Pat. No. 888,005 issued to Fraas; U.S. Pat No. 1,702,279 issued to Slomka; and U.S. Pat. No. 2,194,003 issued to Brooks.

However, no prior art is directed to an office organizer that combines principles of horizontal and Vertical storage, suspension, rotation, compartmentalization and compactness that takes up little space yet provides the user with immediate access to all accessories and supplies needed to perform repeated office tasks on a mass production basis.

OBJECTS AND SUMMARY OF THE INVENTION

It is, therefore, an object of this invention to provide a small, light, accessible, complete yet inexpensive to manufacture office organizer for desks and the like.

It is another object of the invention to provide storage and convenient access to all types of office tools and supplies in a single compact unit.

It is a further object of the present invention to provide an office organizer which creates a means for high-speed production of various operations in office work by placing the user immediately in possession of all the accessories and supplies needed to perform such tasks.

It is another object of this invention to provide a device for use by secretaries, and other office personnel, managers, etc., which will hold pencils, stamps, pads, envelopes, papers, books, pens, clips, markers, etc. in special compartments for ease in locating, grasping, storing and/or removing for use.

Another object of this invention is to provide a unit which is easily transported from one location to another and has a mount to provide rotatibility and to aid the user to directly access any article without inconvenience.

These and other objects of this invention will be apparent from the following description and claims.

DESCRIPTION OF THE DRAWINGS

In the accompanying drawings which illustrate by way of example various embodiments of the invention.

Figure 1:
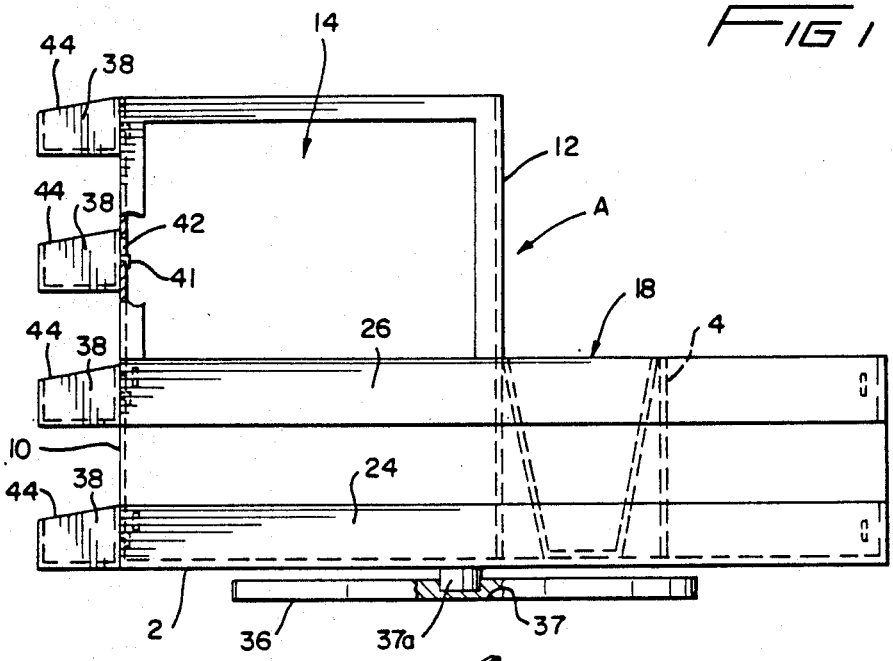
FIG. 1 is a side elevational view of the office organizer showing portions broken away and in phantom.
Figure 2:
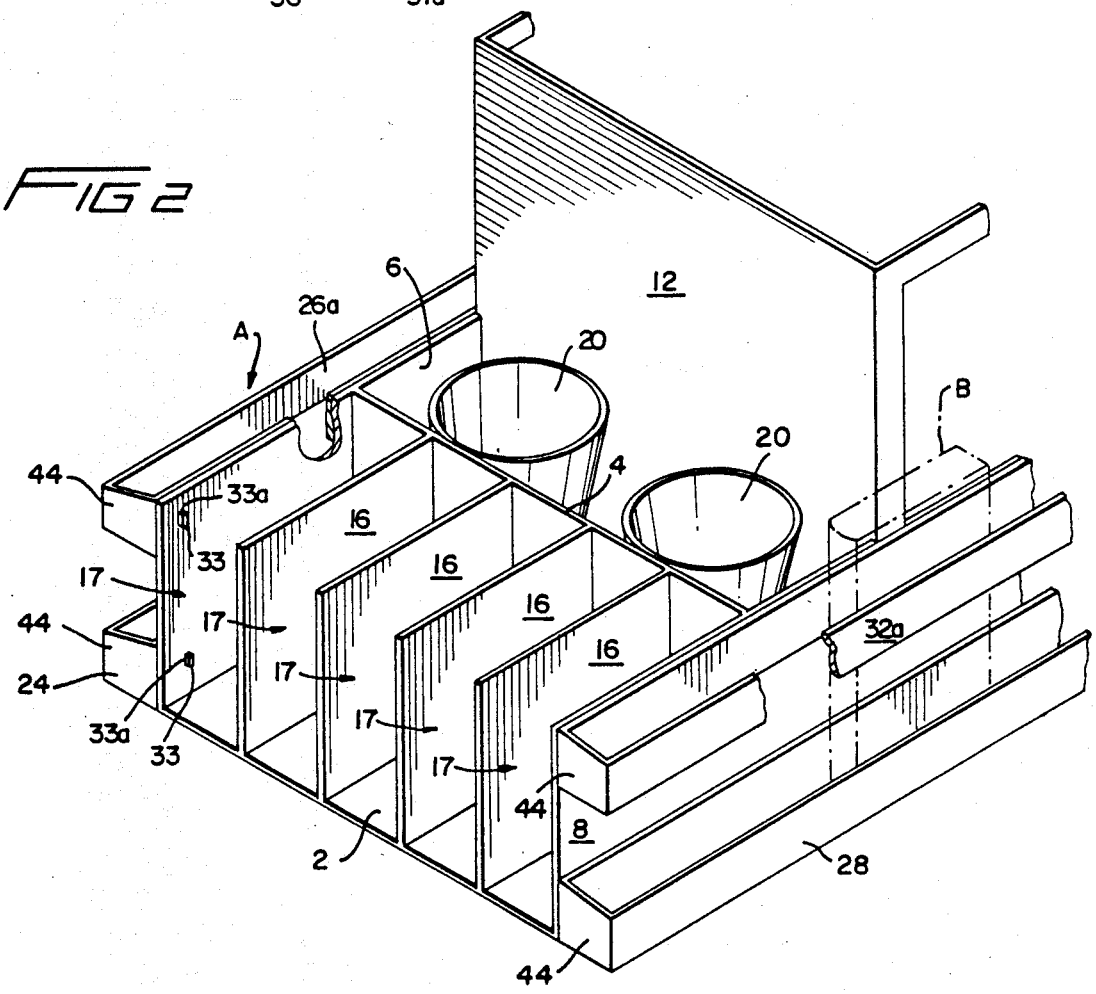
FIG. 2 is a fragmentary front perspective view of the office organizer showing a portion broken away.
Figure 3:
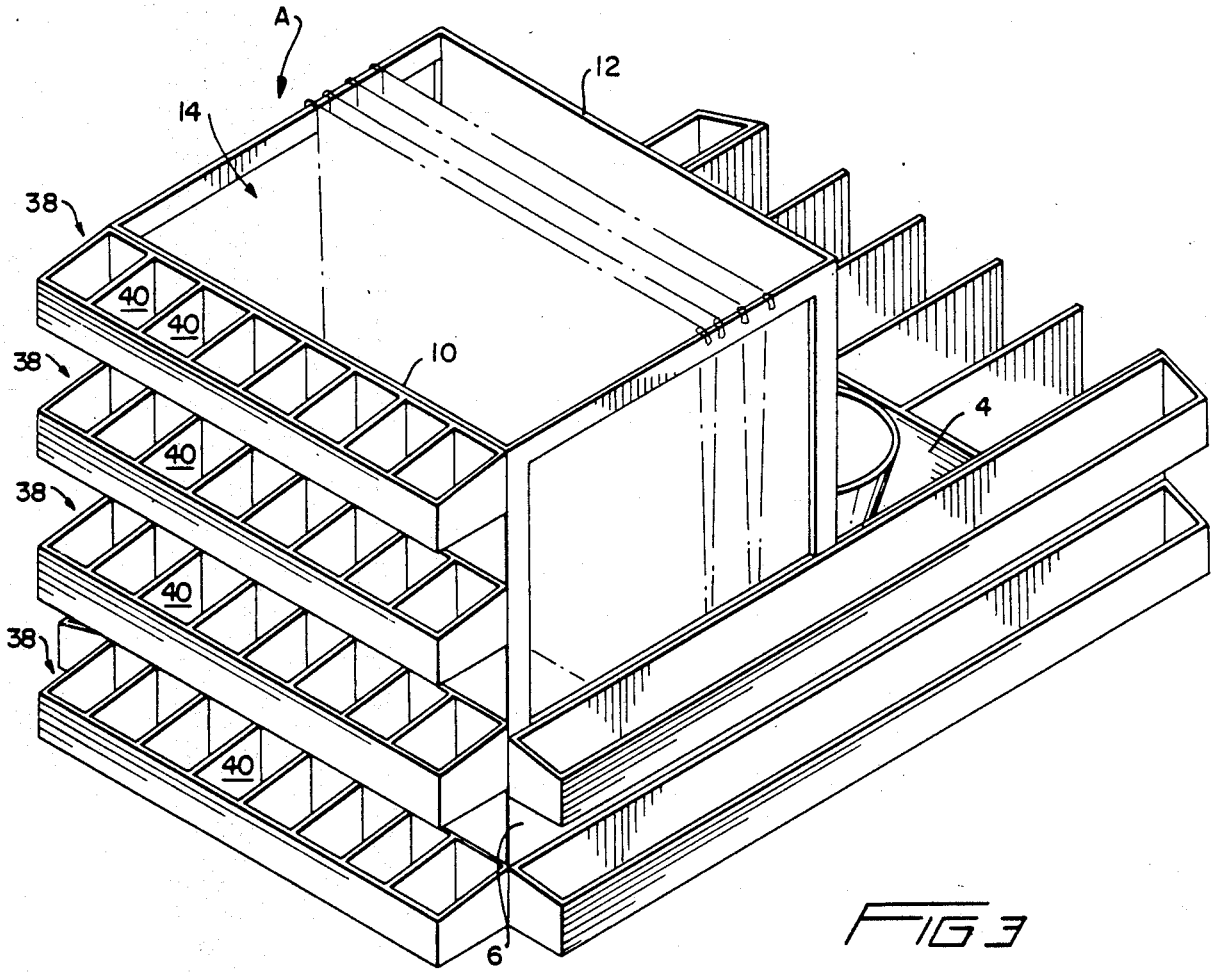
FIG. 3 is a rear perspective view of the office organizer.

Referring now to the drawings, there is shown an assembly A which may be made of plastic, wood or any other suitable material. The assembly A, includes a base 2, a front wall 4, side walls 6 and 8 and rear wall 10 as shown in FIGS. 1 and 2. Positioned between front wall

4 and rear wall 10 is an intermediate wall 12. It should be noted that the intermediate wall 12 is of a height substantially equal to that of the rear wall 10, and side walls 6 and 8 are substantially lower in height than rear wall 10 and intermediate wall 12. The intermediate wall 12 is connected to the side walls 6 and 8 to form with the rear wall 10 and base 2 a first container 14.

Extending forwardly from the front wall 4 and being in height substantially equal to said front wall 4 are a series of partitions 16 as best shown in FIG. 2.

The partitions 16 extending parallel to side walls 6 and 8 form with side walls 6 and 8, front wall 4 and base 2 a series of open ended pockets 17.

The intermediate wall 12 connected to side walls 6 and 8, forms with front wall 4 and base 2 a second container 18 of a height less than the first container 14. Second container 18 includes one or more smaller receptacles 20 that are substantially cup-shaped. Receptacles 20 are substantially the same height as front wall 4.

Figure 4:
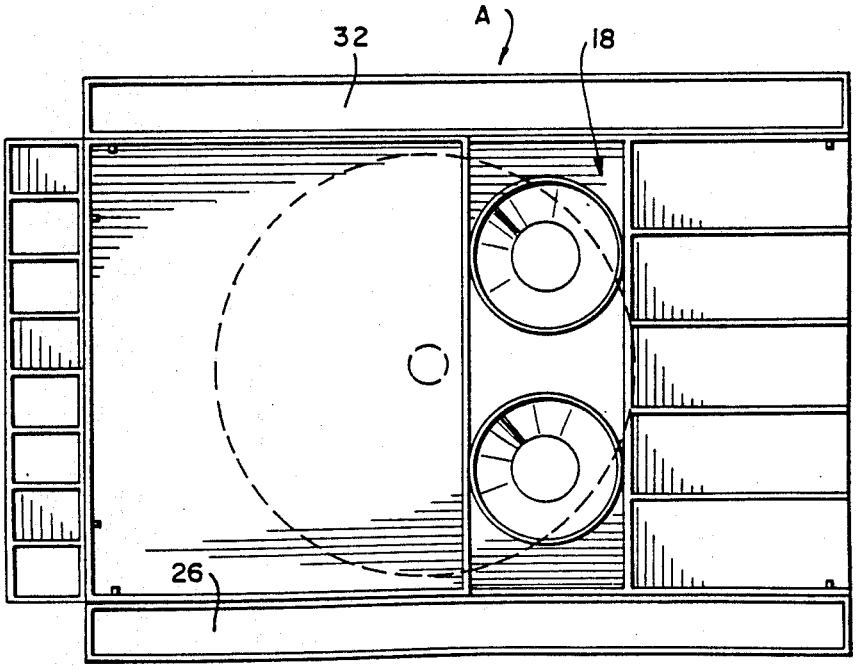
FIG. 4 is a top plan view of the office organizer showing the base support in phantom.

Mounted on side walls 6 and 8 are third containers 24, 26, 28 and 32 as best shown is FIGS. 1, 2 and 4. The third containers 24, 26, 28 and 32 can be mounted to their respective walls 6 and 8 by adhesive or by clips or hooks 33 which engage in an opening 33*a* as shown in FIG. 2. The third containers 26 and 32 may be article retaining straps 26*a* and 32*a* as shown in broken lines in FIG. 2. The article retaining straps 26*a* and 32*a* are coextensive with their respective side walls 6 and 8. Straps 26*a* and 32*a* may be adhesively mounted or secured by clips 33 in opening 33*a* of walls 6 and 8.

As best shown in FIG. 1, a mount 36 is engaged with the base 2 for rotation of the office organizer. A recess 37 receives a journal axle 37*a* for rotating assembly A on the mount 36.

Mounted on the rear wall 10 are a series of vertically spaced similar trays 38. The trays 38 include divider members 40. The trays may be formed as part of the overall assembly A or may be mounted on rear wall 10 by means of adhesive or clips 41 in openings 42 as best shown in FIG. 1.

Third containers 24, 26, 28, 32 and 38 and straps 26*a* and 32*a* have sloped faces 44 as shown best in FIGS. 1 and 2 to permit ease in access.

For illustration purposes, Book B shown in FIG. 2 is supported by straps 32*a* and third container 28. The third containers 24,26,28 and 32 are suitable receptables for larger stationery items such as tape holders, staple guns, calculators and small manuals. These items as well as envelopes, both large and small, deposit slips, payment receipts, etc. may be stored in open ended pockets 17.

It is desirable to utilize first container 14 as a centralized storage unit for various types of stationery or paper items such as typewriter paper, carbon paper, forms, and the like. A wide variety of stationery items may be contained within first container 14 and different items may be separated for rapid access by use of labeled folders or pendaflex dividers.

Receptacles 20 are useful storage containers for narrow, elongated items such as pens, pencils or markers. In smaller stationery items such as erasers, paper clips, postage stamps, tabs, glue, scissors, tapes, and other established tools and supplies of office work are conveniently stored in trays 38 and separated from each other by divider members 40.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention of the limits of the appended claims.

What is claimed is:

1. A desk organizer assembly comprising:

(A) A receptacle having a base, a front, a rear and sides including front, rear and side walls.

(B) Said front, rear and side walls connected to said base;

(C) An intermediate wall positioned between said front and rear walls and of a height substantially equal to said rear wall and connected to said side walls to form with said rear wall and said base a first container;

(D) A series of partitions extending forwardly of said front wall and supported by said base and being in height substantially equal to said front wall;

(E) Said intermediate wall connected to said side walls and forming with said front wall and said base a second container of a height less than said first container;

(F) Said partitions extending parallel to said side walls and forming with said front wall, said base and said side walls a series of open ended pockets extending from said front.

2. A desk organizer as in claim 1 and wherein:

(A) Said second container includes one or more smaller receptacles.

3. A desk organizer as in claim 2 and wherein:

(A) Said smaller receptacles are substantially cup-shaped.

4. A desk organizer as in claim 1 and wherein:

(A) At least one of said side walls includes a third container.

5. A desk organizer as in claim 4 and wherein:

(A) Said third container is of a height less than said first and second containers.

6. A desk organizer as in claim 4 and wherein:

(A) Said side walls of said third container are sloped from rear to front.

7. A desk organizer as in claim 4 and wherein:

(A) At least one of said side walls include article retaining means mounted above said third container.

8. A desk organizer as in claim 7 and wherein:

(A) Said retaining means includes a bracket spaced above said third container and coextensive with the side walls of said third container.

9. A desk organizer as in claim 1 and including:

(A) A rotary mount and (B) Means on said mount and the base of said receptacle for rotary engagement of said base and said mount.

10. A desk organizer as in claim 1 and including:

(A) Fourth container means mounted on said rear wall and extending therefrom.

11. A desk organizer as in claim 10 and wherein:

(A) Said fourth container means includes a series of vertically spaced trays.

12. A desk organizer as in claim 11 and wherein:

(A) Said spaced trays include divider members.

13. A desk organizer as in claim 11 and wherein:

(A) Said spaced trays have end walls sloped from rear to front.

14. A desk organizer as in claim 1 including:

(A) A series of trays mounted on at least one of said front, rear and side walls.

* * * * *